United States Patent [19]

Lester

[11] Patent Number: 4,507,357

[45] Date of Patent: Mar. 26, 1985

[54] SHOE STIFFENERS

[75] Inventor: Roger Lester, Cropston, England

[73] Assignee: USM Corporation, Farmington, Conn.

[21] Appl. No.: 601,803

[22] Filed: Apr. 19, 1984

Related U.S. Application Data

[63] Continuation of Ser. No. 400,451, Jul. 21, 1982, abandoned.

[51] Int. Cl.[3] ..... A43B 23/16; B29C 27/04

[52] U.S. Cl. ..... 428/278; 428/288; 428/290; 428/291

[58] Field of Search ..... 428/278, 260, 288, 290, 428/291

[56] References Cited

U.S. PATENT DOCUMENTS 4,069,602 1/1978 Kremer et al. ..... 428/290 X
4,241,124 12/1980 Kremer et al. ..... 428/290 X

FOREIGN PATENT DOCUMENTS 876073 7/1971 Canada ..... 428/290

OTHER PUBLICATIONS

Hawley, "Condensed Chemical Dictionary", 9th Ed., N.Y., Van Nostrand, p. 283.

*Primary Examiner*—George F. Lesmes
*Assistant Examiner*—Nancy A. B. Swisher
*Attorney, Agent, or Firm*—John P. Morley

[57] ABSTRACT

Shoe stiffeners are now comprising a textile fabric impregnated with a stiffening composition. In the past certain of these have been made by impregnating textile fabric with a solution of stiffening composition. Others have been made by impregnating textiles with an aqueous emulsion of stiffening composition but these have not been as stiff or creep-resistant in wear as corresponding weights of solution impregnated materials. In the invention a plasticizer (solid at wear temperatures and melting at temperatures commonly used in activating shoe stiffeners e.g. above about 50° C.) and an aminoplast resin 3 to 30% based on dry weight of composition are included in the stiffening composition. The stiffeners are sufficiently stiff and creep-resistant to be satisfactory as replacements for many solution-impregnated stiffeners and may be stuck to the upper with hot melt adhesives or latex (if primed).

37 Claims, No Drawings

SHOE STIFFENERS

This is a continuation of application Ser. No. 400,451, filed July 21, 1982 now abandoned.

BACKGROUND OF THE INVENTION (1) Field of the Invention

This invention is concerned with shoe stiffeners, especially stiffeners for use in stiffening the toe or heel end portions of a shoe upper. The term "shoe" is used herein generically to denote outer footwear generally, whether ready for wear or in the course of manufacture.

(2) Description of the Prior Art

In the manufacture of shoes it is a common practice to include in the upper assembly stiffeners in toe and heel regions adhered to the outer integument of the upper to assist in retaining the toe and heel end portions of the shoe in a desired configuration. The stiffeners are commonly adhered to the outer integument of the upper using a suitable adhesive, for example a hot melt adhesive or a rubber latex. One type of shoe stiffener extensively used in shoe-making comprises a textile fabric, for example a non-woven textile fabric, impregnated with a polymer dispersion and subsequently dried to provide the desired stiffness (see for example United Kingdom Patent Specification No. 935001). Such materials are preferably activated by heat to render them malleable for lasting; alternatively they may be activated for lasting by a solvent treatment but the use of solvents is not attractive to some shoe manufacturers even though the stiffeners, after solvent activation, may have better creep resistance and greater stiffness than the equivalent commercially available heat-activated materials. Another type of stiffener widely used comprises a textile fabric impregnated with a polymer solution which is then dried, to provide the desired stiffness: such solution-impregnated stiffeners have in the past generally been stiffer and more creep-resistant than commercially available emulsion-impregnated materials of similar weight. Some shoe manufacturers in the manufacture of certain types of shoe prefer to stick the stiffeners to the shoe upper using latex adhesives e.g. rubber latex adhesive compositions or polyvinyl acetate latex adhesive compositions, while others prefer heat-activated adhesives. Most latex adhesives cannot satisfactorily be used to bond known stiffeners consisting of a textile fabric impregnated with polymer dispersion to the outer integument of a shoe upper.

BRIEF SUMMARY OF THE INVENTION

A shoe stiffener in accordance with the invention comprises a textile fabric impregnated with a stiffening composition. The stiffening composition is, in general, similar to stiffening compositions with which textile fabrics have previously been impregnated to make shoe stiffeners except that the stiffening composition comprises a minor amount of dispersed particles of a plasticiser which is solid and has little or no plasticising effect at normal wear temperatures but which melts and has a plasticising effect at temperatures commonly used in the activation of heat-activatable shoe stiffener elements and further comprises from 3% to 30% based on the dry weight of the stiffening composition of an aminoplast resin.

DESCRIPTION OF THE PREFERRED EMBODIMENTS

Plasticisers melting at more than 50° C. but at temperatures sufficiently low to avoid damage to other components during manufacture of the stiffener or incorporation in a shoe (about 70° C.) are suitable. The amount of plasticiser to be incorporated is chosen to give the required properties in the final shoe stiffener, important ones of which include adequate stiffness, resilience and creep resistance when incorporated in a shoe in wear, satisfactory film-forming capability of the stiffener composition during drying of the material in the course of manufacture, and suitability of the material for sticking to the outer integument of the shoe upper using a hot melt adhesive and a latex adhesive (if necessary with priming). Factors which have a bearing on the amount of plasticiser included in the stiffening composition also include the nature of the remainder of the stiffening composition and the composition of the textile fibres of the textile fabric in the shoe stiffener. If the amount of plasticiser present in the stiffening composition is too low, the effect is too small to ensure adequate activation when the stiffener is to be shaped to a last and adequate film-forming of the stiffening composition during manufacture of the stiffener: not less than 1% plasticiser based on the dry weight of the stiffening composition is preferred. If too high a percentage of plasticiser is present then the stiffener performance again becomes unsatisfactory. Preferably the amount of plasticiser present in the stiffening composition does not exceed 2% based on the dry weight of the stiffening composition; however, higher percentages of plasticiser may be present, for example 6% plasticiser based on the dry weight of the stiffening composition appears to be satisfactory for use with both latex adhesives (when the stiffener material has been primed) and hot melt adhesives based on ethylene/vinyl acetate copolymer. Above 15% by weight plasticiser based on the dry weight of the impregnant may affect the stiffening properties of the material and it is preferred not to exceed 8% by weight plasticiser. It is preferred to include in the stiffening composition about 1½% by weight plasticiser based on the dry weight of the stiffening composition.

The use of a plasticiser in a stiffener in accordance with the invention in the stiffening composition assist in preventing latex adhesives being soaked up to an unacceptable extent by the stiffener, which would lead to poor adhesion to the upper or the use of excessive amounts of latex adhesive. By selection of a suitable plasticiser the adhesion of some hot melt adhesives is facilitated.

Plasticisers included in the stiffening composition are in particulate form. A wide range of particle sizes are effective; however, if the particles are too large there will be a tendency for the plasticiser to precipitate from the stiffening composition and thus the particle size of the plasticiser should be selected to militate against this possibility. Fine particle size plasticisers are preferred, to ensure that the plasticiser is well dispersed throughout the stiffening composition when it is introduced into the textile fabric.

A desirable property which is conferred by the plasticiser is the ability to plasticise the stiffening composition at elevated temperature above the melting point of the plasticiser, to facilitate shoe-making but to have no significant plasticising effect at temperatures normally encountered during wear of the shoe. Preferably, therefore, the plasticiser has a melting point above those normally encountered in wear but below the activation temperature (commonly about 70° C.) of the stiffener for lasting. The preferred plasticiser is dicyclohexylphthalate (melting point 58° C.–65° C.).

A further important constituent of the stiffener composition is the aminoplast resin (or a mixture of aminoplast resins) in amount of from 3% to 30%, preferably from 3% to 14%, more preferably from 3.5% to 7% based on the dry weight of the stiffening composition. It has been found that if an amount of aminoplast resin precondensate as set out above is included in the aqueous emulsion of the stiffening composition with which the textile fabric is impregnated in carrying out a method in accordance with the invention, there is a tendency for the aminoplast resin to migrate to the surface of the stiffener material during drying. The aminoplast resin precondensate also cures during this drying (an accelerator may, if desired, be included in the stiffening composition to facilitate curing). When a shoe stiffener in accordance with the invention comes to be stuck to the outer integument of a shoe upper using a heat-activated adhesive it is found that there is no tendency for the material to adhere to the hot platen of the fusion press used to effect such adhesion: without the aminoplast resin there is a strong tendency for the stiffener to adhere to the platen, which is unacceptable to the shoe manufacturer. The preferred aminoplast resin is melamine-formaldehyde resin; other aminoplast resins which may be suitable for use in the invention include urea-formaldehyde resins. At least 3% aminoplast resin, based on the dry weight of the stiffening composition, is necessary to impart some tendency to not stick to the hot platen during operation of the fusion press; to give reliable protection against such unwanted adhesion it is preferred to use at least 3.5% and preferably between about 4% and 4.5% aminoplast resin based on the dry weight of the stiffening composition. Considerably higher percentages of aminoplast resin may be used but clearly the more aminoplast resin present, the greater the affect of this on other properties of the shoe stiffener. Whilst up to 30% aminoplast resin may be used in some circumstances, it is preferred that not more than 14% be included, more preferably not more than 7% based on the dry weight of the stiffening composition.

The stiffening composition comprises as a main constituent a suitable stiffening polymeric material. A number of such materials are known and these include styrene homopolymers, styrene copolymers, polyvinyl acetate, polyvinyl chloride, acrylic polymers and elastomers e.g. polychloroprene, natural rubber and nitrile rubbers; the stiffening polymeric material may comprise a mixture of suitable polymeric materials. Preferred stiffening polymeric materials comprise styrene polymers with high styrene content, for example modified of unmodified styrene homopolymers, styrene/butadiene copolymers with high styrene content, styrene/acrylate copolymers (suitable styrene/acrylate copolymers are those having only a low carboxylic acid content, to achieve the desired properties), styrene acrylonitrile copolymers and styrene/butadiene/acrylonitrile copolymers all with high styrene content. High styrene content of 75% or more is preferred; a styrene content of about 85% is most preferred.

The stiffening composition may optionally, but also usually will, also include other usual additives, for example surfactants, coalescing agents (to facilitate film-forming of the stiffening composition during manufacture) e.g. diphenyloxitol, butyl dioxitol acetate, or N-methyl 2 pyrrolidone, pigments and/or dyes, and filler; amounts of the other additives are selected according to the performance desired of the shoe stiffener. Care must be exercised in selecting additives to avoid adverse influence on the properties of the stiffener: for example, the stiffening composition should include minimum amounts of surfactants (which are commonly included in the emulsion of stiffening polymeric material) to facilitate the use of latex adhesives.

Various textile fabrics have been used in the manufacture of shoe stiffeners heretofore, including woven fabrics, non-woven fabrics, stitch-bonded fabrics and spunbonded fabrics. Most of the heretofore known fabrics can be used in shoe stiffeners in accordance with the invention. However, non-woven fabrics are preferred, these fabrics preferably being needled, at least to some extent, before impregnation with the stiffening composition. The textile fabrics may be made of various fibres, as have been used heretofore; suitable textile fibres include polyester fibres, viscose rayon fibres, cotton fibres, nylon fibres, polypropylene and acrylate fibres, or mixtures of these. The proportions of stiffening composition and fibre in stiffeners in accordance with the invention may vary over a wide range, as desired. Preferably the ratio of stiffening composition to fibre (dry weights) is between 3.5 to 1 for the heaviest weight stiffeners and 1 to 1 for the lightest weight.

Shoe stiffeners in accordance with the invention may be attached to the outer integument of the shoe upper using a hot melt adhesive. Where it is desired to use a low viscosity polymeric latex adhesive e.g. a natural rubber latex, to attach the stiffener to the outer integument of the shoe upper rather than a hot melt adhesive, a stiffener in accordance with the invention is preferably primed with a suitable primer. One suitable primer comprises a blend of the polymeric latex used in the adhesive composition with an aqueous emulsion of the stiffening polymeric material (in proportion on dry weight of 0.3 to 0.4 parts of the stiffening polymeric material to about 1 part of the latex polymer of the adhesive composition). A suitable filler e.g. finely divided calcium carbonate or clay is included in amount between 0.5 to 1 part by weight of filler to 1 part by weight polymer latex of the adhesive.

Shoe stiffeners in accordance with the invention are preferably made by a method in accordance with the invention which comprises impregnating the textile fabric with an aqueous dispersion of the stiffening composition and drying the impregnated fabric; conveniently the textile fabric is impregnated by passing the textile fabric in a continuous length through a suitable impregnating bath and, after drying, cutting the impregnated fabric into suitable sheets from which shoe stiffeners may be cut for example by die cutting. Depending on the shoe stiffeners to be made, the material during the course of its manufacture at an appropriate point may be subjected to calendering and surface treatment operations to provide the desired material.

It appears that the plasticiser incorporated in the stiffening composition has little or no effect at temperatures below its melting point, for example at lower temperatures encountered during the wearing of the shoe, and therefore does not detract from the desired properties, especially stiffness, creep resistance and resilience of the stiffener during wear; however, during manufacture of the stiffener at high temperatures for example encountered during drying of the impregnated textile fabric in carrying out a method in accordance with the invention, the plasticising efficiency of the plasticiser is increased so that good film-formation occurs during the drying part of the stiffener manufacturing process. Good film-formation is believed to lead to a shoe stiffener of improved stiffness and resilience. Furthermore the plasticising efficiency of the plasticiser at higher temperatures facilitates the rendering of the shoe stiffener malleable for shoe-making. The difference in plasticising efficiency of the plasticisers at the temperatures encountered in the shoe during wear and during manufacture thus leads to advantages over plasticisers heretofore used, for example certain phthalalte plasticisers which are liquid at temperatures encountered during wear of a shoe, which do not exhibit such marked difference in plasticising capability at the appropriate temperatures, nor produce such rapid change in plasticising capability with change in temperature.

There now follows a detailed description of shoe stiffeners and their method of manufacture, embodying the invention, set out hereinafter as examples I and II. It will be realised that the stiffeners and their method of manufacture have been selected for description to illustrate the invention by way of example.

In carrying out both of the illustrative methods a textile fibre fabric is impregnated with an aqueous emulsion of a stiffening composition. The textile fibre fabric comprises a non-woven needled sheet of textile fibres made by conventional processes including carding and cross-lapping, followed by needling. The fibre blend used in making the textile fibre fabric consists of about 70% by weight polyester fibres and about 30% by weight acrylic fibres of between 1.7 and 3.3 decitex.

EXAMPLE I

In the first illustrative method the textile fibre sheet weighs about 170 grammes per square meter. In carrying out the first illustrative method an aqueous dispersion of a stiffening composition constituted as follows is used:

| Constituent | Parts by weight Wet | | Dry |
|---|---|---|---|
| Styrene-acrylate copolymer | 500 | | 250 |
| Plasticiser | 6.25 | | 3.75 |
| Black Pigment | 3.35 | about | 1 |
| Aminoplast resin precondensate | 15 | | 10.5 |

The styrene-acrylate copolymer comprises about 15% butyl acrylate copolymerised with about 0.8 percent of a suitable carboxylic acid e.g. methacrylic acid, and the balance of styrene. The styrene-acrylate copolymer is supplied as a 50% aqueous emulsion. The plasticiser is dicyclohexyphthalate and is supplied as a 60% solids aqueous dispersion. The pigment is supplied as an aqueous dispersion comprising 20–40% solids. The aminoplast resin precondensate is believed to be a methylated melamine-formaldehyde precondensate and, as supplied, has a solids content of about 70%. The textile fibre fabric sheet is impregnated with the aqueous emulsion of the above stiffening composition by passing the sheet through a bath of the dispersion, excess being removed by passing between stripper rolls. The impregnated sheet is then subject to heat, in known manner, to coagulate the stiffening composition and dry the impregnated sheet, the melamine-formaldehyde resin tending to migrate to the surfaces providing a surface on the material militating against sticking of the material to the platen of a fusion press as used in shoe manufacture. The impregnated sheet is heated to film-forming temperature so that the deposited stiffening composition coalesces and the melamine-formaldehyde cures. The dried material has a weight of about 700 grammes per square meter. The first illustrative stiffeners, for stiffening the toe end portion of a shoe upper, are cut from the dried impregnated sheet in known manner. One of the first illustrative stiffeners is adhered to the toe end portion of the shoe upper by coating the stiffener on one side with a suitable heat-activated adhesive composition, placing the adhesive-coated side against the upper and subjecting the toe end portion of the upper to pressure and heat in a toe-puff fusion press to form the bond. The stiffener shows little tendency to adhere to the hot platen of the press and is adequately adhered to the upper. The first illustrative stiffener is rendered sufficiently soft for shaping by heating to about 65° C. but remains stiff and shape-retaining at temperatures normally encountered during wearing of the shoe. The toe end portion of the upper is heated to about 70° C. to render the stiffener malleable and the toe end portion is lasted to conform it to its final shape.

EXAMPLE II

A second illustrative shoe stiffener is made, in carrying out a second illustrative method, in a manner generally similar to the first illustrative stiffener except that the textile fibre sheet weighs about 120 grammes per square meter. The aqueous dispersion of stiffening composition used in carrying out the second illustrative method is as follows:

| Constituent | Parts by weight Wet | | Dry |
|---|---|---|---|
| Styrene-butadiene copolymer | 500 | | 250 |
| Plasticiser | 6.25 | | 3.75 |
| Black Pigment | 3.35 | about | 1 |
| Aminoplast resin precondensate | 15 | | 10.5 |

The styrene-butadiene copolymer comprises about 15% butadiene copolymerised with about 85% styrene. The same plasticiser, pigment and aminoplast resin precondensate are used as in the first illustrative method. The second illustrative method is carried out in a manner similar to the first illustrative method: the impregnated material produced, from which the second illustrative stiffener (a toe puff) is cut weighs about 300 grammes per square meter. One of the toe puffs is coated with a heat-activated adhesive composition and stuck to the toe end portion of the outer member of a shoe upper using a toe-puff fusion press, with no tendency for the puff to stick to the platen of the press. The toe end portion of the shoe upper is heated, after the puff has been firmly stuck, to a temperature of about 70° C. to render the toe puff malleable for toe lasting and the upper is lasted. After cooling, the toe puff is found to be firmly bonded to the outer member of the shoe upper and to firmly retain the toe end portion in the lasted shape during normal wear. The second illustrative stiffener softens sufficiently for lasting at about 65° C. and retains its shape well at temperatures normally encountered during wear or storage of the shoe.

Suitable heat-activated adhesives for use with the first and the second illustrative stiffeners include heat-activated polyester adhesive compositions, hot melt ethylene-vinyl acetate copolymer, polyvinyl acetate or polyamide adhesive compositions.

Alternatively the first and second illustrative stiffeners may be bonded to shoe upper components using polymer latex adhesive compositions, preferably natural rubber latex adhesive compositions. Where latex adhesive compositions are to be used, the impregnated sheet is coated, preferably before drying, with a suitable primer composition. A suitable primer composition (in the form of an aqueous dispersion) for the first illustrative stiffener is as follows:

| Constituent | Parts by weight (Solids) |
|---|---|
| Styrene-acrylate copolymer | 100 |
| Natural Rubber | 280 |
| Finely ground calcium carbonate filler | 234 |

The styrene-acrylate copolymer is as used in the stiffening composition and the primer is made by mixing (in the appropriate proportions) the copolymer emulsion with the natural rubber latex forming the basis of the adhesive composition, with the addition of the filler. A suitable primer for the second illustrative stiffener is the same as for the first except that the styrene-acrylate copolymer dispersion is replaced by a suitable amount of the styrene-butadiene copolymer of the second illustrative stiffener.

Whereas materials in accordance with the invention are primarily intended for heat activation, using hot melt or rubber latex adhesives, certain materials in accordance with the invention may, if desired, be solvent-activatable. For example, the first illustrative material may be activated by solvent to a malleable, though not tacky, condition and a coating of suitable adhesive which has first been applied, e.g. a pva adhesive, is also activated by the solvent to stick the stiffener to the upper.

From the above description there has been shown improved shoe stiffeners which can be used in the manufacture of shoes in various manufacturing methods. Further, these stiffeners have improved stiffness and creep resistance at wear temperatures.

We claim:

1. A shoe stiffener comprising a textile fabric impregnated with an aqueous stiffening composition with is subsequently dried and which comprises a stiffening polymeric material, an amount of a particulate plasticiser between about 1% to about 15% based on the dry weight of the stiffening composition, said plasticiser being solid at normal room temperature and having little or no plasticising effect at normal room temperatures but which has a plasticising effect at temperatures commonly used in the activation of heat activatable shoe stiffener elements, from 3% to 30% based on the dry weight of the stiffening composition of an aminoplast resin which migrates to the surface of the stiffening composition and cures during drying of the stiffening composition and, optionally, other usual additives.

2. A stiffener according to claim 1 where the plasticiser has a melting point between more than 50° C. to about 70° C.

3. A stiffener according to claim 1 in which the plasticiser has a melting point of more than 50° C.

4. A stiffener according to claim 1 in which the plasticiser is present in an amount from 8% to up to 15% based on the dry weight of the stiffening composition.

5. A stiffener according to claim 1 in which the plasticiser is present in an amount of between 1% and 8% based on the dry weight of the stiffening composition.

6. A stiffener according to claim 1 in which the plasticiser is present in an amount between 1% and 2% on the dry weight of the stiffening composition.

7. A stiffener according to claim 1 in which the plasticiser is dicyclohexylphthalate.

8. A stiffener according to claim 1 in which the aminoplast resin is a melamine-formaldehyde resin.

9. A stiffener according to claim 1 in which the aminoplast resin is present in an amount from 3% to 14% based on the dry weight of the stiffening composition.

10. A stiffener according to claim 1 in which the aminoplast resin is present in an amount from 3.5% to 7% based on the dry weight of the stiffening composition.

11. A stiffener according to claim 1 comprising between 3½ and 1 part by weight stiffening composition to 1 part by weight fibers of the textile fabric.

12. A stiffener according to claim 1 in which the stiffening polymeric material comprises styrene homopolymer and/or copolymer.

13. A stiffener according to claim 1 in which the fibres of the textile fabric comprise polyester.

14. A stiffener according to claim 1 in which the fibres of the textile fabric comprise viscose rayon.

15. A stiffener according to claim 1 in which the textile fabric is a non-woven fabric.

16. A stiffener according to claim 1 having a coating of a primer composition on a surface thereof, the primer composition having been applied as an aqueous dispersion comprising the stiffening polymeric material and a polymeric latex, the polymeric latex being a primary component of a latex adhesive composition by which it is intended that the stiffener should be bonded to a shoe upper.

17. A stiffener according to claim 16 in which the polymeric latex is a natural rubber latex.

18. A stiffener according to claim 16 in which the primer composition comprises between 2 and 4 parts by weight of polymeric latex solids to 1 part by weight of stiffening polymeric material solids.

19. A stiffener according to claim 16 in which the primer composition comprises a particulate filler.

20. A method of making a shoe stiffener comprising impregnating a textile fabric with an aqueous emulsion of a stiffening composition comprising a stiffening polymeric material, an amount between about 1% to about 15% based on the dry weight of the stiffening composition of dispersed particles of a plasticiser which is solid and has little or no plasticising effect at normal room temperatures but which has a plasticising effect at temperatures commonly used in the activation of heat activatable shoe stiffener elements, from 3% to 30% based on the dry weight of the stiffening composition of an aminoplast resin precondensate which migrates to the surface of the stiffening composition and cures during drying of the impregnated fabric and optionally, other usual additives, and drying the impregnated fabric.

21. A method according to claim 20 where the plasticiser has a melting point between from more than 50° to about 70° C.

22. A method according to claim 20 in which the plasticiser has a melting point of more than 50° C.

23. A method according to claim 20 in which the stiffening composition comprises from 8% up to 15% plasticiser based on the dry weight of the composition.

24. A method according to claim 20 in which the stiffening composition comprises between 1 and 8% by weight of plasticiser, based on the dry weight of the composition.

25. A method according to claim 20 in which the stiffening composition comprises between 1 and 2% by weight of plasticiser, based on the dry weight of the composition.

26. A method according to claim 20 in which the plasticiser is dicyclohexylphthalate.

27. A method according to claim 20 in which the aminoplast resin is a melamine-formaldehyde resin.

28. A method according to claim 20 in which the aminoplast resin is present in an amount from 3% to 14% based on the dry weight of the stiffening composition.

29. A method according to claim 20 which the aminoplast resin is present in an amount from 3% to 7% based on the dry weight of the stiffening composition.

30. A method according to claim 20 in which the stiffening polymeric material comprises styrene homopolymer and/or copolymer.

31. A method according to claim 20 in which the fibres of the textile fabric comprise polyester.

32. A method according to claim 20 in which the fibres of the textile fabric comprise viscose rayon.

33. A method according to claim 20 in which the textile fabric is a non-woven fabric.

34. A method of making a shoe stiffener according to claim 20 comprising coating the impregnated textile fabric with a primer composition comprising an aqueous dispersion of the stiffening polymeric material and a polymeric latex, the polymeric latex being a primary component of a latex adhesive composition by which it is intended that the stiffener should be bonded to a shoe upper.

35. A method according to claim 34 in which the polymeric latex is a natural rubber latex.

36. A method according to claim 34 in which the primer composition comprises between 0.3 and 0.4 parts by weight of stiffening polymeric material solids to 1 part by weight of polymer latex solids.

37. A method according to claim 34 in which the primer composition comprises 0.5 to 1 part by weight of a particulate filler to 1 part by weight polymer latex solids.

* * * * *